United States Patent [19]

Badger

[11] Patent Number: 4,553,417

[45] Date of Patent: Nov. 19, 1985

[54] IMPLANTATION OF CERTAIN SOLID LUBRICANTS INTO CERTAIN METALLIC SURFACES BY MECHANICAL INCLUSION

[75] Inventor: Philip O. Badger, Niles, Mich.

[73] Assignee: Miracle Metals, Inc., Denver, Colo.

[21] Appl. No.: 619,823

[22] Filed: Jun. 12, 1984

Related U.S. Application Data

[63] Continuation-in-part of Ser. No. 465,333, Feb. 9, 1983, abandoned, which is a continuation-in-part of Ser. No. 254,944, Apr. 16, 1981, abandoned.

[51] Int. Cl.[4] ..... B21D 53/10; B05D 3/00; C21D 6/00; C21D 9/46; F16C 33/10

[52] U.S. Cl. ..... 72/42; 29/148.4 L; 29/149.5 R; 148/12 E; 308/241; 427/318

[58] Field of Search ..... 29/148.4 L, 149.5 R, 29/156.4 WL; 72/42, 46; 148/12 E, 12 EA, 12.1, 135, 136, 156; 308/241; 427/318, 360, 365, 369

*Primary Examiner*—E. Michael Combs

*Attorney, Agent, or Firm*—Simmons, Perrine, Albright & Ellwood

[57] ABSTRACT

A solid lubricant such as $MoS_2$ is applied to certain carbon and stainless steels after surface voids have been produced in the material by one or two annealings before final cold working the material to finished size. The latter operation imbeds or includes the lubricant into the material and thereby provides a superior lubricated steel for piston rings, shaft, valve stem, spring, stranded wire, and the like applications. The technique involved may also employ corrosion inhibiting agents to increase resistance to corrosion of the steel as well as to impove its lubricity.

13 Claims, No Drawings

IMPLANTATION OF CERTAIN SOLID LUBRICANTS INTO CERTAIN METALLIC SURFACES BY MECHANICAL INCLUSION

CROSS REFERENCE TO RELATED APPLICATION

This application is a continuation-in-part of application Ser. No. 465,333, filed FEB. 9, 1983, abandoned, which is a continuation-in-part of application Ser. No. 254,944, filed Apr. 16, 1981, and now abandoned.

FIELD OF THE INVENTION

The invention relates to improved techniques of treating certain steels with certain solid lubricants to mitigate boundary friction and wear of those steels in sliding contacts and to increase resistance to corrosion.

BACKGROUND OF THE INVENTION

Molybdenum disulfide ($MoS_2$), for instance, is a well known, versatile inorganic solid lubricant having a lattice layer crystal structure. Inherent basal cleavage occurring within its atomic structure results in low lamellar shear strength and contributes to its superior anti-friction or lubricious properties. There is evidence to show that this property is caused by Van der Waals type bonding between two molecular unit cells on the basal plane connecting the six-fold symmetry of the respective layers comprising the crystal structure as a whole. It is precisely these chemical bonds, relatively long in physical length, which cause low lamellar shear strength and therefore low dry friction measurement on sliding and rotating contact. Conversely, the chemical bonding occurring in the crystal plane located at right angles to the basal plane is more typical of the monovalent type, shorter in physical length and therefore many times stronger. Recent studies show the hardness for the basal plane as measured on the Vickers Scale to be 32 Kg./mm$^2$ and that for the crystal plane to be 900 Kg./mm$^2$, the latter thus being harder by a multiple of nearly 29. Such a difference in physical measurements within a single unit crystal causes anisotropy, a condition which permits implantation of molybdenum disulfide into metal surfaces to be practical and achievable.

In some motor spring applications an inorganic film containing $MoS_2$ and bonded to the spring material has been utilized to improve the torque consistency of such springs. Motor springs so treated have proved extremely useful in various mechanical time fuzes and in horological mechanisms of the classic escapement types. Indeed, clocks with such springs have sometimes been operated 300% longer than those without coated springs before rewinding is required. The increased performance in these instances is a product of the reduction in the kinetic coefficient of friction between the spring leaves during the unwinding process, that is to say, a reduction in the "stick-slip" phenomenon historically associated with main spring applications.

Application of films of $MoS_2$ to various metallic substrates is usually by spraying or dipping methods and subsequent drying and/or baking, or even by electroplating the molybdenum directly to the substrate and then heat treating in an atmosphere containing sulfur or sulfide gases. Whatever the technique, however, it is performed after the material has been processed to final or finished size. It has been suggested that transfer of the $MoS_2$ film to a metallic substrate in these instances is primarily a mechanical process resulting in (a) direct embedding of the solid $MoS_2$ into a softer surface, (b) deposition of the solid $MoS_2$ into surface depressions generated in the substrate by an "abrasive" action of the solid $MoS_2$ itself during movement between the substrate and an opposing surface, and/or (c) deposition of the solid $MoS_2$ into the depressions indigenous of the original surface finish and hardness of the substrate. But whatever the case may be, and however satisfactory and lasting these techniques may be for certain applications, the results are not satisfactory in the case of items subject to high surface wear. The $MoS_2$ film, essentially still only a surface film, simply does not endure in these environments but is rather quickly removed or destroyed by abrasion. Such high wear items as piston rings, bearings, journals, valve stems, shafts, and the like, for instance, are composed of various grades of high carbon or stainless steels and though obviously many of them could profit from the low friction characteristics and protection afforded by $MoS_2$, especially when other lubrication is at a minimum, no feasible way, so far as is known, has emerged for treating them with $MoS_2$ such that the latter becomes a much more enduring part of the steel itself.

Cold drawn wire for use in stranded wire constructions, such as wire rope for lifting mechanisms, ship board cable systems, aircraft control cable and the like, and for use in coil springs such as compression, extension and torsion types, is also typically manufactured from various high carbon steel alloys. The finished wire is furnished to the spring manufacturer, for example, and the springs themselves are formed by various operations including coiling, grinding, secondary forming, stress relieving, plating and, in many instances, special packing. Likewise, the wire for stranded wire cnstructions is also shipped to a separate place for manufacture of the rope itself. The wire for both springs and rope is produced by a combination of cold working, annealing and final tempering operations to a predetermined diameter and shipped on spools, reels or loose wound coils.

Significant improvement in the performance of stranded wire cables ought also to be achieved by a solid libricant such as $MoS_2$ applied to the wire strands in view of earlier work done by the Polymer Corporation of Reading, Pa., where crane sheaves made of nylon containing a fine dispersion of $MoS_2$ were manufactured and tested. The lifetime of wire cable passing over the special sheaves was increased, in comparison to that when using standard sheaves. Eventual failure was caused by friction between individual strands in the wire cable.

Aircraft carrier arresting cables represent another area of utility for a solid lubricant such as $MoS_2$. Current practice is to reduce friction and corrosion of such cables by repeated applications of a barrier film, such as grease. But the grease is gradually removed from the cable during use and causes the flight deck to become slippery in critical places. In addition, the grease, being flammable, is a fire hazard, and its elimination would thus provide safer operating conditions. Another carrier-related problem is corrosion of internal aircraft control cables by salt air, and those too ought to be improved both in longevity and corrosion resistance by such a lubricant.

In short, a wide range of products formed from certain carbon and stainless steels ought to benefit greatly from treatment by a solid lubricant such as $MoS_2$ if only the endurance of the treatment could be increased by making the lubricant more a part of the steel itself. Not only would friction be reduced but corrosion resistance increased as well in those applications where corrosion is a problem that must be reckoned with. These are thus the chief objects of the present invention.

SUMMARY OF THE INVENTION

The invention takes advantage of certain properties of certain carbon and stainless steels when they are cold worked in order to bring them down to a predetermined finished size. Here and in the appended claims by "cold working" is meant operations such as drawing, forging, rolling and other standard methods of cold working metal. When certain steels are cold worked they tend, as is well known, to "work hardened", the extent of the working hardening increasing with the amount of carbon contained in the steel, whereupon they must be annealed in order to relieve the dislocation of their crystal lattice which the cold working has produced, the annealing being done at each metal's "recrystallization" temperature and normally in an inert or controlled atmosphere to avoid surface oxidation. After annealing the metal is then suitable for further cold working. Hence, in many applications the cold working process involves a succession of cold workings interspersed by a succession of annealings, the number of each and their arrangement depending upon the extent to which the metal must be reduced in cross sectional size, sometimes referred to as "breaking down" of the metal to finished size.

After certain steels are annealed in an inert atmosphere, their surfaces become "rough", that is to say, small "voids" are created, because of the recrystalization of the metal which occurs during the annealing process. These voids are receptive to the deposit of a solid lubricant. If before the deposit of the lubricant the metal is given a second, shorter annealing in air, a phenomenon called "carbide precipitation" occurs owing to the interstitial nature of the metals concerned. During cold working the metal substrate forms macromolecular carbon clusters between asperities on the metal's surface from which the heat of the subsequent annealing process in air removes the carbon, thus "decarburizing" the surface of the steel. The voids on the surface of the metal thereby become more pronounced in size and number at the end of the subsequent annealing operation and so are even more receptive to the deposit of a solid lubricant. Of course if when practicing the invention the steel is not in a work hardened state to begin with, either because it has never been cold worked or if so has previously been annealed, then only the decarburizing anneal would be necessary before application of the lubricant.

The essence of the invention, therefore, is the application of a solid lubricant such as $MoS_2$, for instance, to the metal after the final anneal but before final cold working, the final anneal in this case in effect constituting a preparation of the metal for deposit of the $MoS_2$. At that time the surface hardness of the metal is less than it is after final cold working and tempering. Hence the final cold working, which may of course consist of a series of reductions in size of the metal, will effectively embed the $MoS_2$ into the micro-structure of the metal substrate owing to the extreme pressures involved. Furthermore, the anisotrophic properties of the $MoS_2$ allow the latter better to penetrate the voids than is possible when the $MoS_2$ is applied to the metal substrate after final cold working when the substrate possesses a higher superficial hardness. Since the greater the carbon content of the steel, the greater the work hardening, the higher carbon steels will profit most from the invention since the pressure to work harden them will be greater and thus the inclusion of the lubricant better. AISI-SAE Nos. 1035 to 1095 carbon steels should give satisfactory applications of the invention. Probably, No. 1010 low carbon steel would be unsatisfactory because pressure upon it would tend to cause it to flow too much rather than work harden, thus not sufficiently imbedding or including the lubricant. Just where the minimum satisfactory carbon content is between Nos. 1010 and 1035 steels has not been determined. Also having a bearing upon the matter is whether the steel after the final cold working must later be bent to form a particular item since the greater the final working hardening the more difficult the bending to a prescribed shape. In the case of stainless steels probably AISI Types 301, 302, 304, 305, 316, 316L, 416 and the like should give acceptable results. So by "certain carbon and stainless steels" here and in the appended claims are meant (1) carbon steels from No. 1095 on down to some number above 1010 which, in the light of the foregoing, will serve satisfactorily for the application concerned, and (2) stainless steels of the above Types.

Typically, Mo is in micro-powder form which is sulfonated to obtain $MoS_2$, also a powder. That is then sometimes mixed with graphite in a liquid carrier such as perchlorethylene, the graphite being added to improve lubricity at lower loads. When one form of the invention is practiced the $MoS_2$ in the foregoing state is further mixed with an inorganic binding agent such as sodium silicate. After the final annealing operation the steel is coated, in the manner hereafter described, with the foregoing mixture and the perchlorethylene "flash evaporated" before the final cold working operation. Doubtless other methods of coating the steel would serve, such as perhaps spraying, electroplating, applying an adhesive to the surface and then dipping the steel into dry $MoS_2$ powder, etc. Where corrosion is not a problem this manner of practicing the invention is satisfactory. But in enviroments where the steel is open to corrosion when employed in various finished products, the graphite tends to accelerate corrosion rather than to decrease it even though the surface of the steel is decarburized by the final annealing. In order to avoid that effect the invention is practiced in another form in which graphite is omitted and an organic based synthetic resin system is used as the binding agent in place of sodium silicate. The system includes a corrosion inhibiter in the form of a "redox" resin.

The latter are synthetic polymers having a highly cross-linked hydro-carbon matrix with inherent reversible functional groups attached, such as quinone-hydroquinone, which are alternately oxidized and reduced. In terms of corrosion inhibiting these resins can be referred to as "election exchangers", "redox ion exchangers" or simply redox resins. In fact rapidly reacting $MoS_2$ bonded films containing organic based binding systems including redox resins have only comparatively recently become commercially available. The corrosion inhibiting principle is based upon the slowing of the reaction rate in which corrosion occurs. In the oxidation phase, as metallic components ionize they attract anions and form a soluble salt or oxides, causing erosion of the base metal. In the reduction phase metallic cations are attracted toward cathodic cells that are created or become present owing to the ambient environment. The latter type of corrosion is typically termed galvanic corrosion. When redox resins are present and in intimate contact within the surface interface, they act as solid electrolytes facilitating an electrical balance, chemically speaking, and cause the rate at which the various reactions occur to be slowed. Corrosion protection is afforded the base alloy even in the absence of a sacrificial addition of anodic protection.

Since tungsten disulfide ($WS_2$) and graphite (C) are also solid inorganic lubricants, having lattice layer crystal structures similar to $MoS_2$, it is believed and forecast that they and any other solid inorganic lubricant of similar characteristics could also advantageously be included using the process of the invention though to date no tests have yet been conducted to that end. Furthermore, it is contemplated that antimony thioantimonate ($Sb.\dot{S}bS_4$) might be added to the $MoS_2$, $WS_2$ or C. This is because recent studies have shown that certain complex chalcogenides used in combination with solid lubricants, such as $MoS_2$, $WS_2$ and C, have improved the wear properties of steel in counter-conformal sliding contact under partial hydrodynamic conditions in the presence of certain greases having those lubricants as additives. Among these chalcogenides are arsenic thioantimonate and antimony thioantimonate. The first, unlike the second, is suspected of being toxic and is therefore not deemed suitable.

DETAILED DESCRIPTION OF THE PREFERRED EMBODIMENTS

The invention will first be set forth in terms of a partially predicted application of a solid lubricant to the manufacture of piston ring material for internal combustion engines.

Piston rings for that purpose are typically fabricated from various high carbon steel alloys. Usually the material is furnished the ring manufacturer in the form of flat strips of cross-sectional dimensions, for example, of 0.61 mm by 2.70 mm in the case of material for oil control rings, produced by a combination of cold working, annealing and final tempering operations. The invention, of course, would be practiced by the manufacturer of the strips before the latter are shipped to the ring maker. Assume, for example, a strip of the above dimensions in finished size whose cross sectional area is thus 1.665 $mm^2$. Assume further that the interim cross-sectional area of the strip after a penultimate cold working and an ultimate anneal but before the final or ultimate cold working is 4.645 $mm^2$ whereby the latter operation accomplishes about a 65% reduction in cross-sectional area.

Essentially the invention may be practiced in this instance by coiling an interim size strip, after preparation by final annealing, on a take-off drum providing a low back tension on the strip and then recoiled on a suitable take-up drum spaced from the former drum in a sometimes called "coil-to-coil" operation. Between the two drums is disposed a tank, which may be open to the atmosphere, of perhaps 84 liter capacity and equipped with a suitable stirring device. Into the tank is placed a mixture of solid, micro-meter sized particles of the lubricant, e.g., $MoS_2$, graphite, a liquid carrier such as perchlorethylene and an inorganic bonding agent such as sodium silicate, all more or less at room temperature. Between the tank and the take-up drum is placed a thermostatically controlled oven or furnace capable of maintaining a temperature of about 260° C. over a distance of 2 linear meters. The strip from the take-off drum is then led by suitable well known means through the mixture in the tank, which is agitated by the stirring device in order to keep the $MoS_2$ in suspension, from which it emerges "wet", and then through the oven where the perchlorethylene is "flash evaporated" in order to produce a dry bonded film of $MoS_2$ on the strip, the latter being finally recoiled on the takeup drum, all at the rate of about 3.65 linear meters per minute. A 34 liter mixture containing 3275 cc of solid $MoS_2$, sodium silicate, and graphite in the proportions of 71, 22 and 8, respectively, the balance being perchlorethylene should result in a dry bonded film of $MoS_2$ on the strip of between 0.0025 nd 0.005 mm thickness. The strip from the take-up drum is next finally cold worked to its finished cross-sectional dimension in the usual manner and then tempered at about 200° C. The temperatures of the strip during the deposit of the $MoS_2$, the riddance of the carrier liquid and the final cold working and tempering operations, should be kept below the oxidation temperature of the $MoS_2$ which is about 425°–480° C. Even so, the oxidation rate of $MoS_2$ to $MoO_3$ is quite slow and studies have shown that $MoS_2$ does not lose its lubricity at those temperatures until 30% or so has been oxidized.

As a result the $MoS_2$ is mechanically embedded or "included" in the working surfaces of the piston ring material to a greater extent than would be the case were the $MoS_2$ applied in the usual manner as a film after cold working to finished size. This is borne out by a quantity of piston ring high carbon compression ring steel, AISI-SAE-C1075, in the form of cold rolled strip 1.78 mm thick and sub-critically annealed for 5 hours at 649° C. in an argon atmosphere. The material was divided into three specimens: the first was left without treatment; the second had a 0.0051 mm thick film of $MoS_2$ applied to it using sodium silicate as a bonding agent; the third was given a brief anneal in air at 649° C. to decarburize it and then a bonded film of $MoS_2$ as in the second specimen. The extra annealing or decarburization of the third specimen before treatment was done in order to determine what effect that would have on depth penetration with respect to implantation of $MoS_2$ into the microstructure of the substrate. All specimens were then returned to the mill and cold rolled to 0.60 mm thickness, a reduction in cross-sectional area of about 65%.

Upon their return from the mill the second and third specimens were then cut lengthwise at right angles to the direction of rolling or grain elongation to determine the amount of $MoS_2$ inclusion within the micro-structure of the substrate. Observation of the cut specimens showed partial and total mechanical inclusion of $MoS_2$ in unusually large deposits. The depth of the inclusion in the case of the second specimen was 0.02 mm while that of the third or decarburized specimen was 0.028 mm. Hence it appeared that the depth of the inclusion is a function of the depth and/or size of the respective surface voids; that is to say, the degree of inclusion appears constant at about 55–60% of the starting depth of the surface voids concerned for a given amount of cold working. It was also concluded that annealing of the steel before treatment produces a relatively soft ferritic transformation near the surface compared with the underlying pearlite and therefore that ferritic layer on the surface of the substrate lends itself to substrate embodiment by the implantation process of the invention.

Friction tests performed on the first and third specimens showed a reduction in friction by approximately 25% in the case of the third specimen compared with the first. This was determined, briefly speaking, by mounting each specimen and two strain gauges intermediate the ends of a lever pivoted at one end and loaded by a weight at the other. Each specimen pressed upon the peripheral surface of a disk of AISI 4340 steel 73 mm in diameter and 7.2 mm thick revolving at a constant 100 rpm. No fluid lubrication was used between the specimens and the disc. Output of the strain gauges were led through an amplifier to a Brush Mark 220 strip chart recorder.

Wear tests were also conducted on the second and third specimens using the above test apparatus by weighing the specimens before and after in order to determine the loss of weight of the specimens during the tests. The following results were obtained, the weight loss values being averages of three to five tests:

| Weight on specimen (kg) | Average weight loss (mg) | | Reduction of wear of specimen 3 vs. specimen 2 (%) |
|---|---|---|---|
| | Specimen 2 | Specimen 3 | |
| 2.5 (10 min.) | 2.1 | 1.5 | 29 |
| 2.0 (10 min.) | 1.1 | 1.05 | 5 |
| 1.25 (20 min.) | 1.15 | 0.77 | 33 |
| 1.0 (20 min.) | 0.85 | 0.78 | 8 |

The data shows that the third specimen (that having the extra annealing and hence decarburization and thus a deeper implantation of $MoS_2$) compared with the second specimen (that having only the initial annealing) has less material loss for each of the applied loads. The cummulative average material loss for the third specimen was 19% less than that for the second.

In another test, two plain carbon steel strips, AISI-1078, were annealed in air. One was then coated with a mixture of $MoS_2$ and a bonding agent, sodium silicate in a liquid carrier, dried, and reduced by cold working to 3.28 mm width and 0.61 mm thickness. The other strip was cold worked to the same dimension before being coated with the foregoing mixture. Both strips were then mounted in epoxy so that their cross-sections were visible and ground and polished using 0.05 micron alumina powder. Precautions were taken to minimize edge rounding during the polishing. Both samples were then viewed with incident light in a metallurgical microscope at magnifications up to 1,000×. The first sample showed numerous inclusions of dark material into the surface to typical depths of 0.025 mm, while the second sample showed no such inclusions.

Further wear tests were conducted using C1075 steel specimens to compare untreated steel ("plain steel"), steel coated with $MoS_2$ by spraying as in the prior art ("sprayed steel"), and steel treated by the process of the invention including the extra annealing ("Badger steel"). Each specimen had undergone a final cold working which reduced its cross-sectional area by 65%, the cold working of the sprayed steel having been done before application of the $MoS_2$ and that of the Badger steel after two annealings, one in an argon atmosphere and the other in air, and application of the $MoS_2$. Essentially the same test apparatus described above was used and the surfaces of the specimens were loaded onto the steel disc sufficiently to guarantee that boundary lubrication conditions were present, producing a value of PV of equal to around 80,000 lb-in.$^{-2}$ ft min$^{-1}$. This quantity represents a measure of how much energy per unit time (or power) is being absorbed by the specimen surfaces in a counter-conforming mode of sliding contact with the disc. The quantity P is the load per projected area, and the quantity V is the relative velocity of the two surfaces. This value of PV has been found to cause significant wear of untreated surfaces under boundary lubrication conditions. For each test five examples of each of the three specimens were fabricated and were each weighed on a chemical balance capable of discrimination to four places of decimals of a gram. The test apparatus was then run in each case at 100 rev/min, a direct load of 2.5 kg was applied together with the requisite number of oil drops per hour. The following table gives the weight of material removed by wear as well as the rate of lubrication of the contacting surfaces:

| Type of Surface And Oil Rate | Initial Weight gms | Final Weight After 1 hr gms | After 2 hr gms | After 3 hr gms | After 4 hr gms |
|---|---|---|---|---|---|
| Plain Steel | | | | | |
| 8 drops/hr | 0.4685 | 0.4670 | 0.4585 | 0.4584 | |
| Sprayed Steel | | | | | |
| 60 drops/hr | 0.4824 | 0.4757 | | | |
| 8 drops/hr | 0.4735 | 0.4714 | 0.4668 | 0.4507 | |
| Badger Steel | | | | | |
| 60 drops/hr | 0.4799 | 0.4793 | | | |
| 8 drops/hr | 0.4917 | 0.4915 | 0.4914 | 0.4915 | 0.4915 |

Rate of Revolution = 100 rev/min
Surface Direct Load = 24.5 newton
Approximate Value of PV = 80,000 lb-in$^{-2}$ ft min$^{-1}$
No of Samples for Each Test = 5

It is clear from the table that under conditions of boundary lubrication the wear rate of the Badger steel is substantially zero after the first hour's run, and its actual wear rate is only one-tenth that of the sprayed steel. In addition, in the case of the sprayed steel, wear appears to continue after the first hour and its rate is approximately 50% greater than that of the plain steel after 1 hour's run. After two hours running, the rate of wear increases and thence the sprayed steel has approximately twice the wear rate of the plain steel. Another remarkable aspect is that the at the begining of the runs the width of the contact area between the specimens and the steel disc of the test apparatus was 0.254 mm while at the conclusion of the runs that width in the case of the plain steel was 1.524 mm but only 0.762 mm in the case of the Badger steel. Hence the contact area of the plain steel was twice that of the Badger steel so that the pressure upon the latter was twice that upon the former. Therefore the greatly improved wear rate of the Badger steel was obtained even though the pressure upon it rose to twice that upon the plain steel.

No essential change in the steel itself, from the standpoints of hardness, strength, and the like, seems to occur when treated by the process of the invention. The steel can thereafter be fashioned into piston rings, for instance, but the typical operation of chrome plating of the finished ring would be omitted. The customary differential in superficial hardness between the chrome plated ring and the cylinder wall is thus reduced and thereby wear on the wall itself is also diminished. At the same time wear on the ring is reduced because its inherent lubrication supplements normal liquid or hydrodynamic lubrication between the ring and the cylinder wall. The lubricated ring better withstands high operating loads, better operates for short periods with boundary lubrication, better distributes local loads, and betters the wear characteristics of the mating surfaces. This is especially important adjacent top and bottom dead centers since the greatest wear of a cylinder wall in an internal combustion engine has been found to occur where piston direction changes and where the oil film is unable to accumulate sufficient thickness to separate the two opposing surfaces. This is because the zero velocity of the piston at those two points means that the hydrodynamic requirement of relative velocity between opposing surfaces is not met at these precise locations. The lubricated rings, on the other hand, provide supplemental lubrication at these points at these crucial times, something a chrome plated ring cannot do, as well as over the entire cylinder wall during the critical breakin period of a new engine.

The invention was also practiced on a length of 101.6×3.1 mm medium carbon steel, AISI 1035, designed to be later made into annular bearing inserts or bushings for engine valve rocker arms. A medium carbon steel was selected rather than a higher one because, since it does not work harden as much, it could be more easily rolled into bushing shape. The steel, having before been cold rolled down to its 3.1 mm thickness, was first annealed in an argon atmosphere for 5 hours at 649° C., then decarburized by exposing the surface to air at the same temperature for 6 minutes, and finally allowed to cool. The steel was then immersed in a pickling solution to remove surface oxides, washed with hot water, and coated, one side at a time, with $MoS_2$ in the previously mentioned binder and solvent together with a corrosion inhibitor. Final cold working was performed by rolling the steel down to 1.50 mm thickness, an approximate 52% reduction. Two sections were then removed, mounted in epoxy, polished, and photographed at a magnification of 1,000× using 2% Nital as an etchant. Using ASTM E45 charts, the Jernkontoret Method showed the following:

| Sample | Grade Thin Series | Grade Thick Series |
|---|---|---|
| 1 | 3 | 1 |
| 2 | 3 | 1 |

The invention will next be set forth in terms of a predicted application of a solid lubricant to the manufacture of cold drawn wire for use in springs and stranded wire constructions. Assume, for example, wire having a finished diameter of 0.71 mm or a cross-sectional area of 0.40 $mm^2$, and that the interim diameter of the wire after a penultimate cold working operation and the second annealing but before the ultimate cold working operation is about 1.90 mm or a cross-sectional area of 2.84 $mm^2$, whereby the latter operation accomplishes about an 85% reduction in cross-sectional area. Also assume that the first anneal was accomplished in the usual manner in a non-oxidizing atmosphere to achieve recrystalization and that second anneal is performed in a strand type annealer at about 650° C. for a flash type decarburization of between 40 and 60 seconds duration, the latter operation deepening the void zones to about 0.045 mm and thus optimizing the surface for mechanical inclusion pursuant to the invention.

As before, the wire after the latter annealing operation, may be coiled on a pay-off reel with which is appropriately associated a take-up reel for a coil-to-coil coating operation. Between the two reels is disposed a refrigerated tank of perhaps 70 to 80 liter capacity into which is placed a mixture of solid, micro-meter sized lubricant, e.g., $MoS_2$, organic based binding agents, such as phenolic-vinyl-resin or epoxy-vinyl-resin, together with redox resins to act as corrosion inhibiting agents, and a quick drying composite solvent or liquid carrier consisting of 60% cellulose acetate, 30% xylene, and 10% methyl ethyl ketone. The refrigeration of the tank is regulated to keep the mixture at a temperature between 0° and 5° C. owing to the volatility of the solvent. Between the tank and the take-up reel is also disposed a thermostatically controlled oven or furnace capable of maintaining a temperature of 260° C. over a distance of 2 linear meters. The wire from the pay-off reel is then led by well-known means through the mixture in the tank which is agitated by a suitable stirring device in order to keep the $MoS_2$ in suspension. The wire then emerges from the tank "wet" and into the oven where the solvent is "flash evaporated" in order to leave a dry bonded film of $MoS_2$ on the wire. The latter is recoiled on the take-up reel at the rate of 3 to 3½ linear meters per minute, the rapid rate of reaction of the resins concerned being essential because of the relatively immediate recoiling of the wire after it has passed through the tank. Finally, the wire is transferred to a suitable wire drawing installation and reduced in cross-sectional area, that is to say, cold worked, to its previously mentioned finished diameter. Such cold working in this case should be kept at temperatures below about 315° C. because the resins involved tend to decompose above that point.

Wire so treated would have several advantages. For instance, when used to manufacture coil springs, expensive postplating for corrosion protection would become unnecessary, thus eliminating the inherent problems of hydrogen embrittlement, tangling of springs, and the absence of plating between the close-wound coils of extension springs. Furthermore, the wire would retain improved ductility and toughness compared to hot dipped galvanized wire because the brittle alloy between the zinc and the steel interface would be eliminated. The same or similar advantages would also accrue to such wire when employed in various stranded wire construction, as previously mentioned. To the extent the final cold working diminishes some of the corrosion inhibiting properties achieved by the invention, for added protection the wire can be recoated with $MoS_2$ by the previously described prior art methods after final cold working.

The invention is also believed applicable to other high wear components previously mentioned, such as bearings, journals, shafts and so forth, on which it would be practiced in manners analogous to those described in the cases of piston rings and wire. Thus though the invention has been described in terms of particular embodiments and procedures, being the best modes known of carrying out the invention, it is not limited to those embodiments and procedures alone. Instead, the following claims are to be read as encompassing all adaptations and modifications of the invention falling within its spirit and scope.

I claim:

1. A process of providing a lubricious surface for certain carbon and stainless steels for high wear applications wherein a length of the steel is reduced from an initial larger to a final smaller cross-sectional size by one or more cold workings, characterized by: preparing the surface of the steel including annealing the steel in order to form voids on the surface thereof; covering the surface of the steel by coating the same with micrometer sized particles of at least one inorganic solid lubricant; and subsequently cold working the steel after said coating to reduce the same to said final cross-sectional size, the temperatures during said coating and subsequent cold working being below the oxidation temperature of the lubricant.

2. The process of claim 1 further characterized by the steel having been cold worked prior to said annealing.

3. The process of claim 2 further characterized by said annealing comprising successive anneals to recrystalize the steel and then to decarburize the surface thereof before said coating.

4. The process of claim 3 further characterized by the addition of antimony thioantimonate to the lubricant.

5. The process of claim 1 further characterized by the lubricant being selected from the group consisting of molybdenum disulfide, tungsten disulfide, and graphite.

6. The process of claim 5 further characterized by the steel having been cold worked prior to said annealing.

7. The process of claim 6 further characterized by said annealing comprising successive anneals to recrystalize the steel and then to decarburize the surface thereof before said coating.

8. The process of claim 7 further characterized by coating the steel with a mixture of said lubricant and a bonding agent in a liquid carrier after said subsequent cold working.

9. The process of claim 7 wherein said coating is further characterized by covering the surface of the steel with a mixture of said lubricant and a bonding agent in a liquid carrier and then removing the liquid carrier by drying before said subsequent cold working.

10. The process of claim 9 further characterized by the addition of antimony thioantimonate to the lubricant.

11. The process of claim 9 further characterized by the liquid carrier being perchlorethylene and the bonding agent being sodium silicate.

12. The process of claim 9 further characterized by the bonding agent being an organic based synthetic resin and the liquid carrier being a composite solvent.

13. The process of claim 12 further characterized by the bonding agent also including a redox resin.

* * * * *